US007186169B2

(12) United States Patent
Kawata

(10) Patent No.: US 7,186,169 B2
(45) Date of Patent: Mar. 6, 2007

(54) ANGLE POSITIONING TOOL AND HAND-SCALER GRINDING DEVICE USING SAME

(75) Inventor: Sousaku Kawata, Kanuma (JP)

(73) Assignee: Nakanishi Inc., Kanuma (JP)

( * ) Notice: Subject to any disclaimer, the term of this patent is extended or adjusted under 35 U.S.C. 154(b) by 0 days.

(21) Appl. No.: 10/505,750

(22) PCT Filed: Feb. 21, 2003

(86) PCT No.: PCT/JP03/01911

§ 371 (c)(1),
(2), (4) Date: Aug. 26, 2004

(87) PCT Pub. No.: WO03/072303

PCT Pub. Date: Sep. 4, 2003

(65) Prior Publication Data

US 2005/0142992 A1 Jun. 30, 2005

(30) Foreign Application Priority Data

Feb. 27, 2002 (JP) ..... 2002-051395
Jul. 11, 2002 (JP) ..... PCT/JP02/07048

(51) Int. Cl.
*B24B 3/40* (2006.01)

(52) U.S. Cl. ..... 451/164; 451/349

(58) Field of Classification Search ..... 451/164, 451/349, 409

See application file for complete search history.

(56) References Cited

U.S. PATENT DOCUMENTS 2,324,025 A * 7/1943 Revell ..... 451/164
4,509,268 A * 4/1985 Marquam et al. ..... 33/201
4,821,462 A * 4/1989 Moore ..... 451/555
5,426,999 A * 6/1995 Seiler et al. ..... 76/82
6,074,293 A * 6/2000 Bleier ..... 451/558
6,852,014 B1 * 2/2005 Gleason ..... 451/45
6,971,949 B2 * 12/2005 Gleason ..... 451/234

FOREIGN PATENT DOCUMENTS

| | | |
|---|---|---|
| JP | 56-17149 | 4/1981 |
| JP | 7-20244 | 4/1995 |
| JP | 7-30355 | 4/1995 |
| JP | 2000-024889 | 1/2000 |
| JP | 2000-202748 | 7/2000 |
| JP | 2001-054840 | 2/2001 |
| JP | 2002054840 | 2/2001 |

* cited by examiner

*Primary Examiner*—M. Rachuba
(74) *Attorney, Agent, or Firm*—Hahn & Voight PLLC

(57) ABSTRACT

The object of the present invention is to provide an angle setting tool for setting the blade section of a hand scaler at a predetermined angle during sharpening of the scaler, and a hand scaler sharpening device which has a relatively simple structure, is easy to operate and do maintenance, and reduces complexity in the sharpening operation. This object is achieved by a hand scaler sharpening device including a sharpener main body having a grind stone (50) provided for reciprocating motion, and an angle setting tool (41) for setting the tip of a hand scaler at one of a plurality of predetermined angles on the grind stone (50), wherein the angle setting tool (41) has a plurality of inclined surfaces (42*a*, 43*a*, 44*a*) corresponding to the predetermined angles.

16 Claims, 10 Drawing Sheets

図1
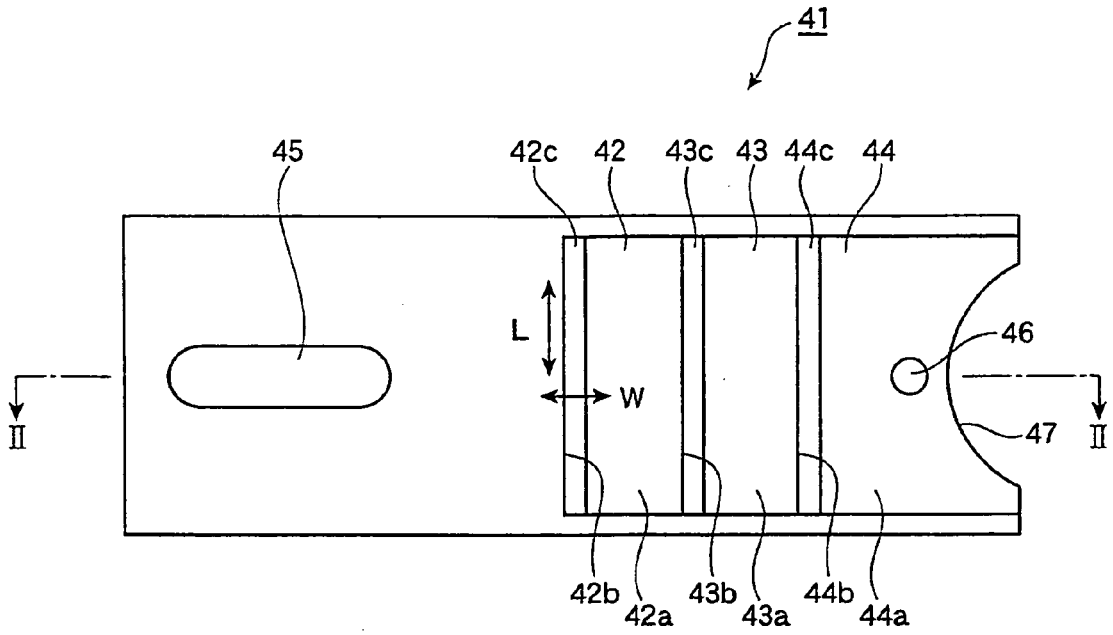
図2
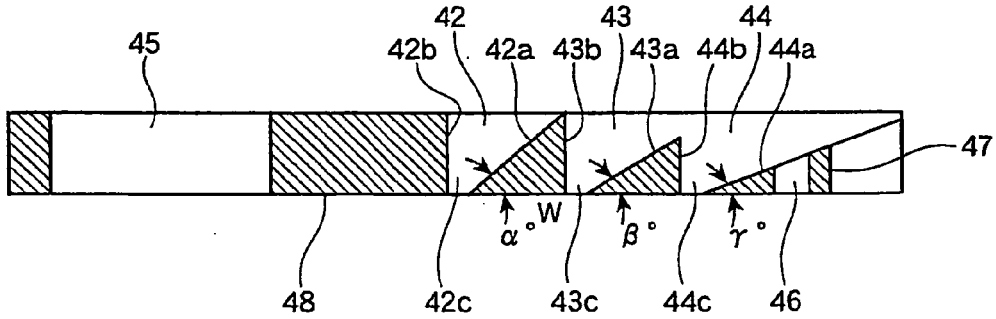

図3
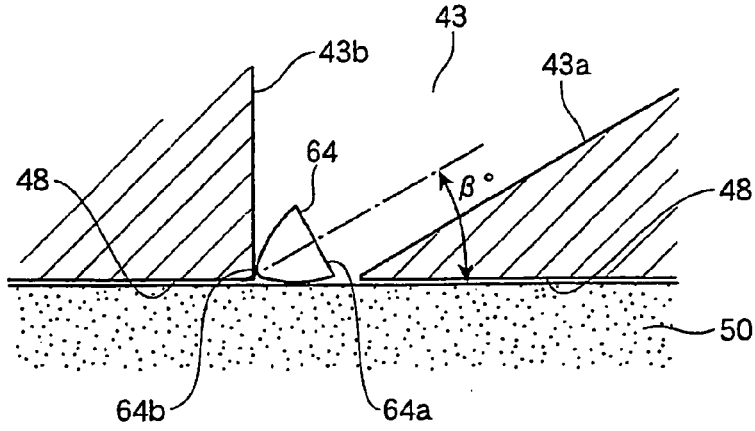
図4
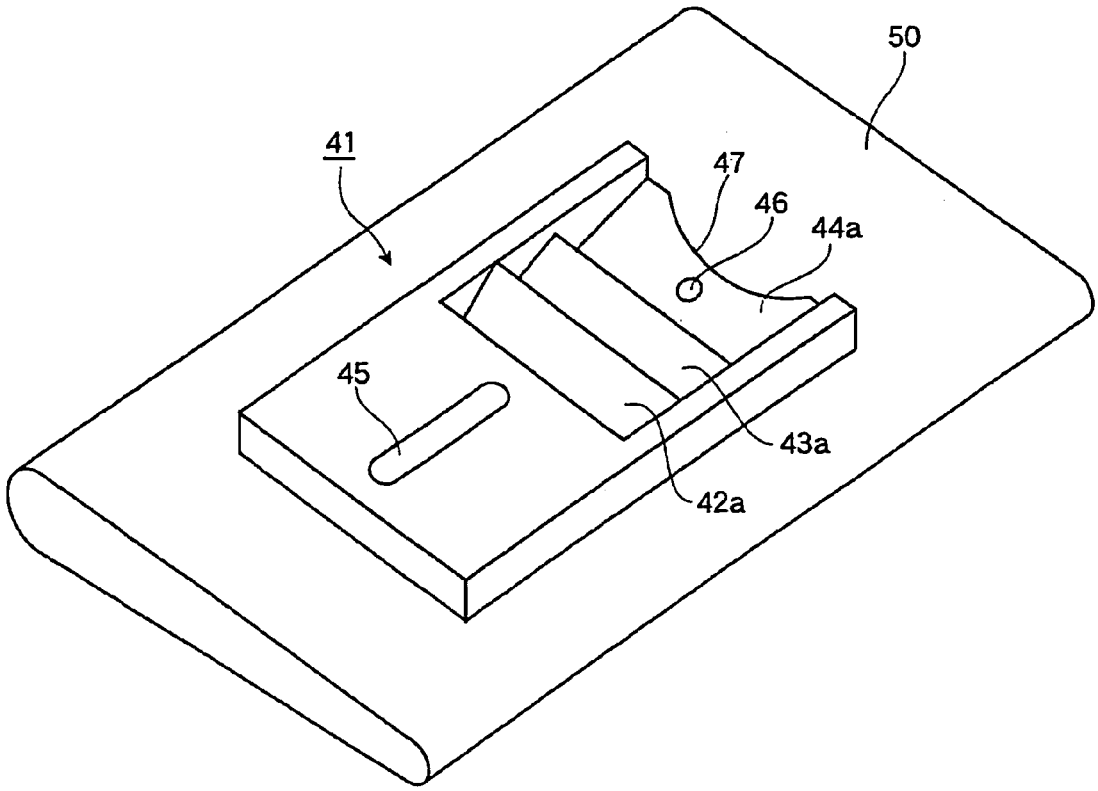

図5
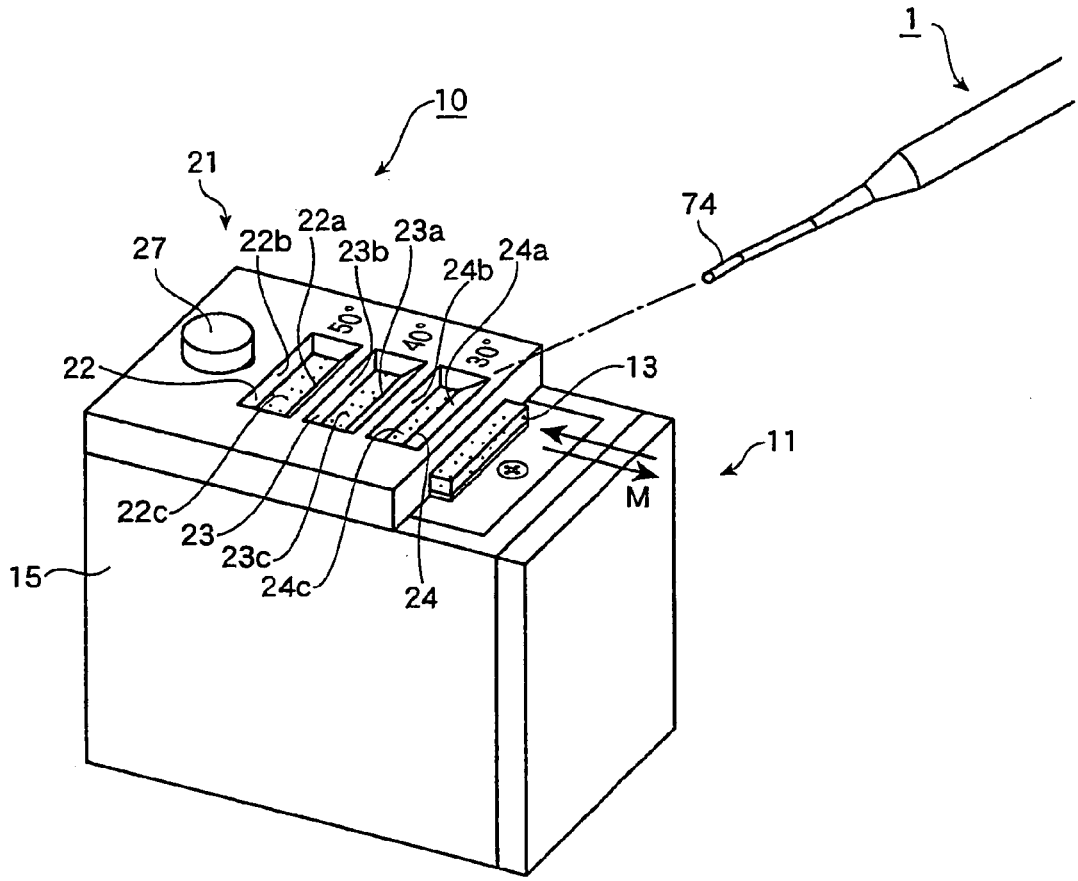

図6
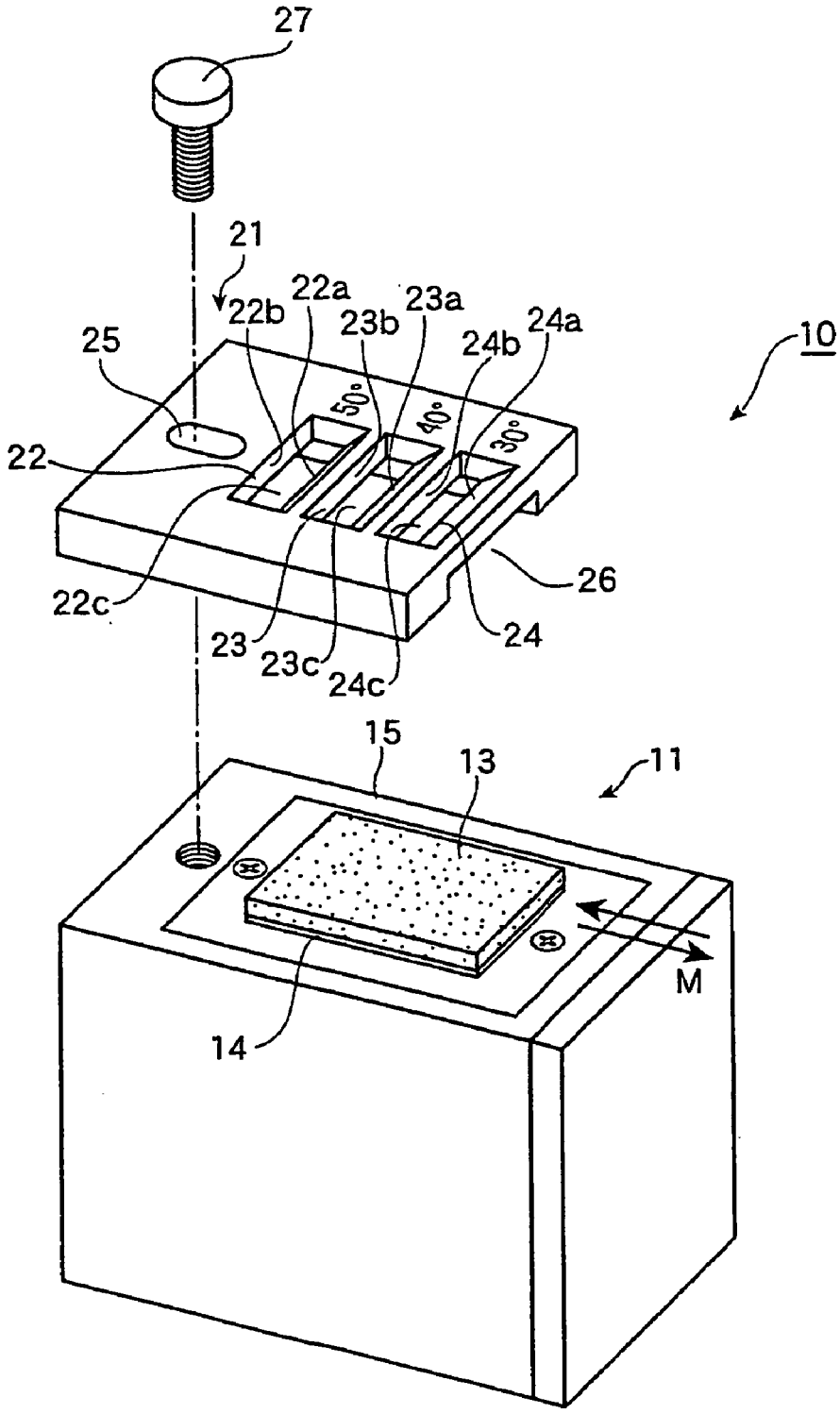

図7
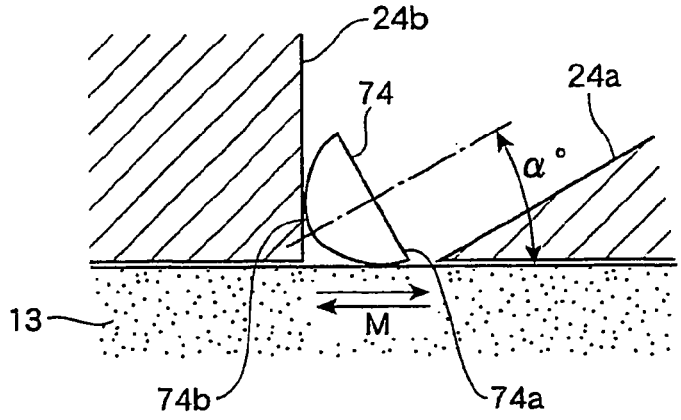
図8
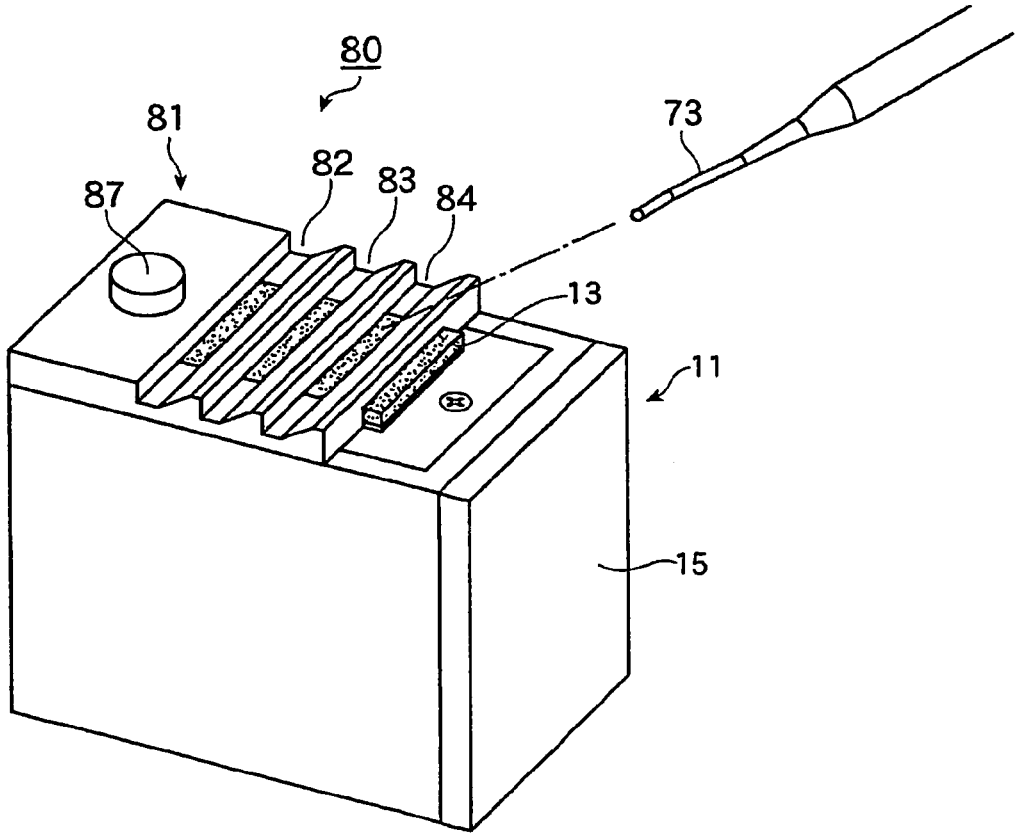

図9
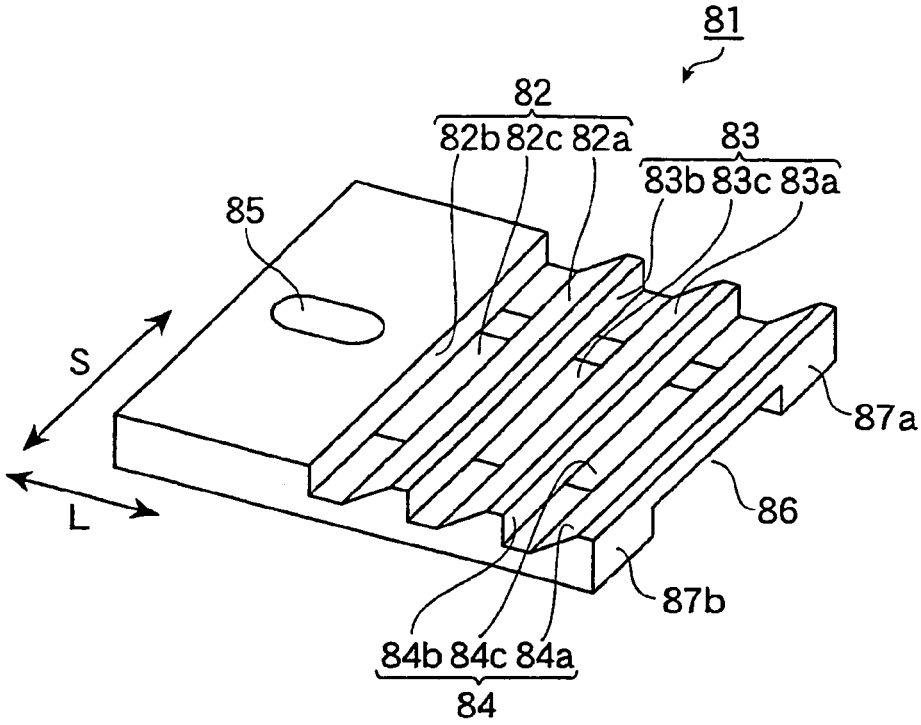
図10
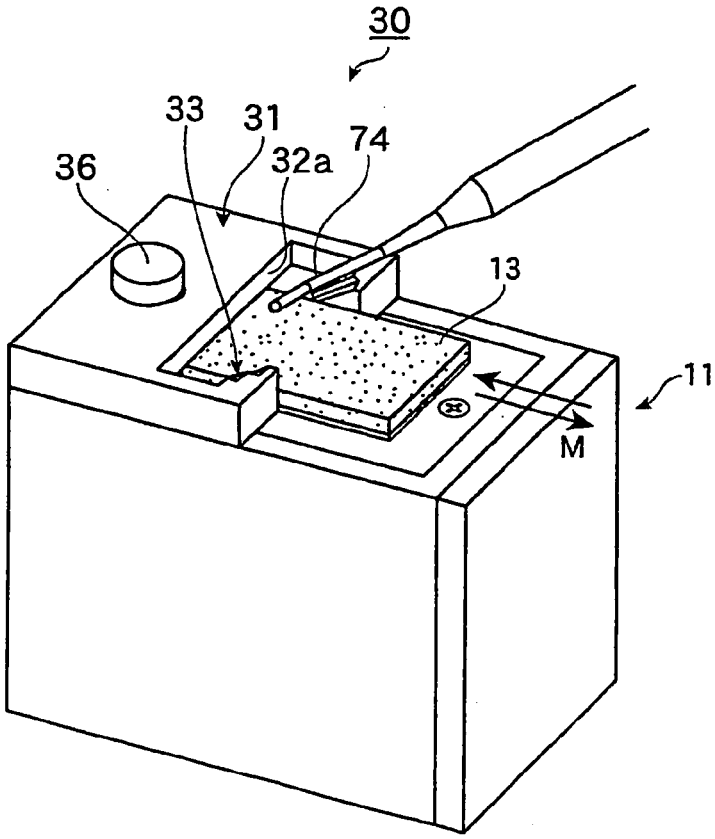

図11
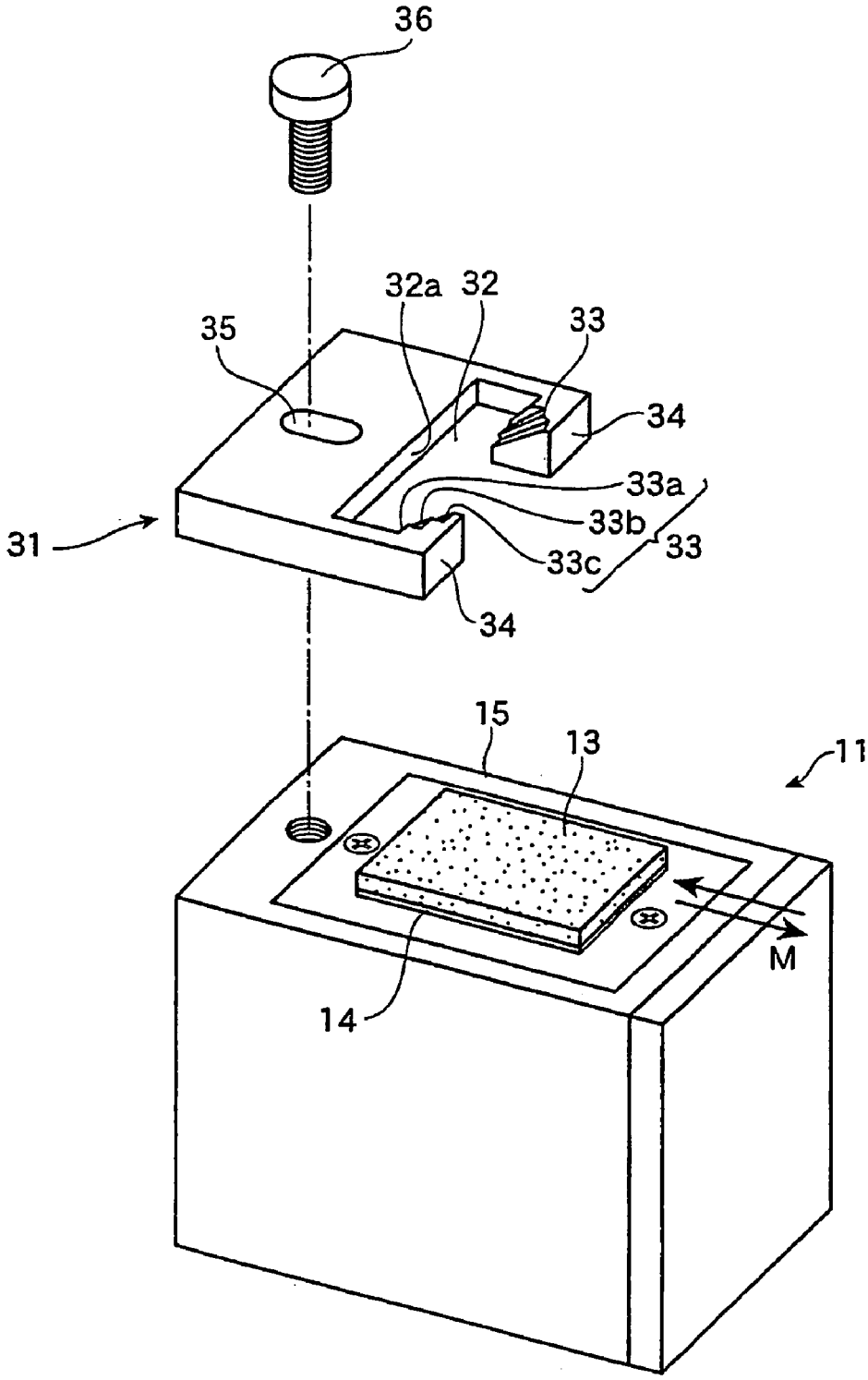

図12
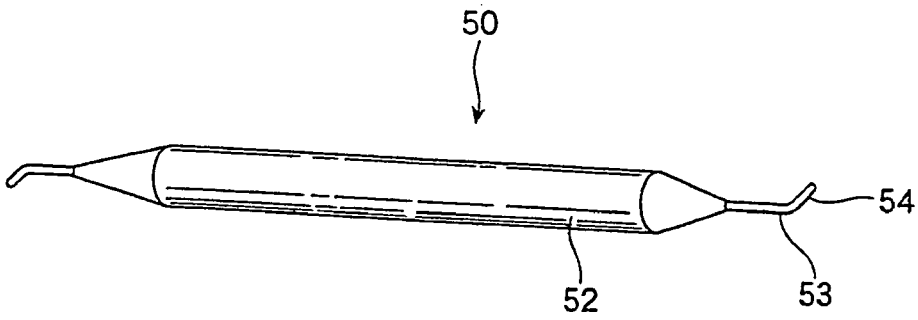
図13
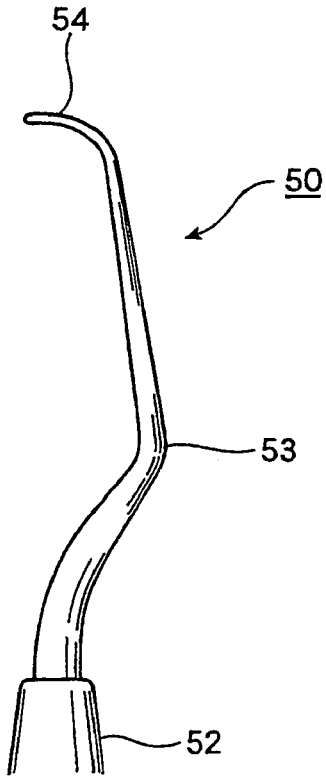

図14
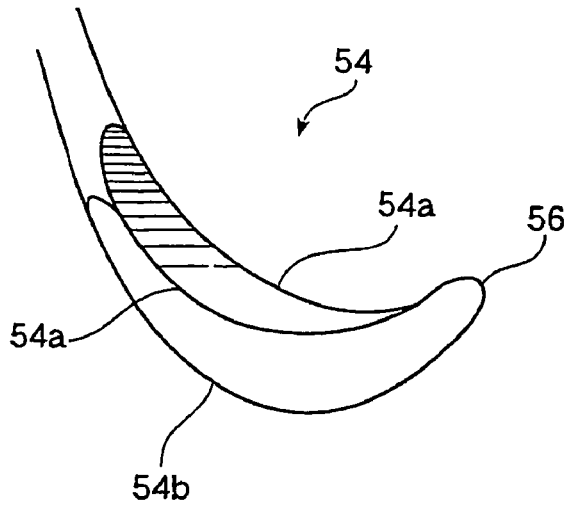
図15
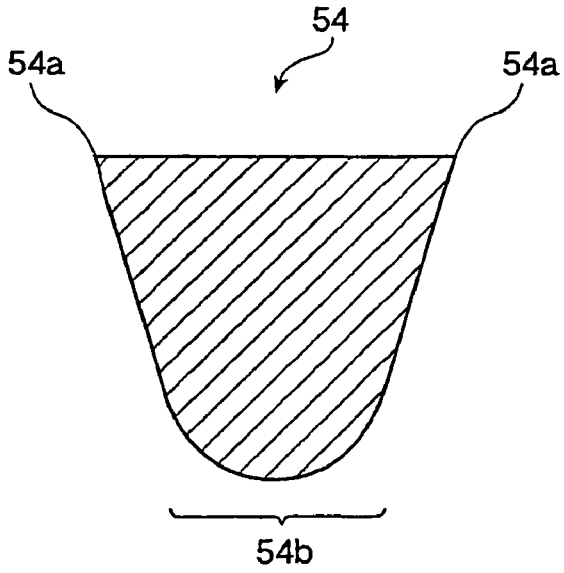

図16
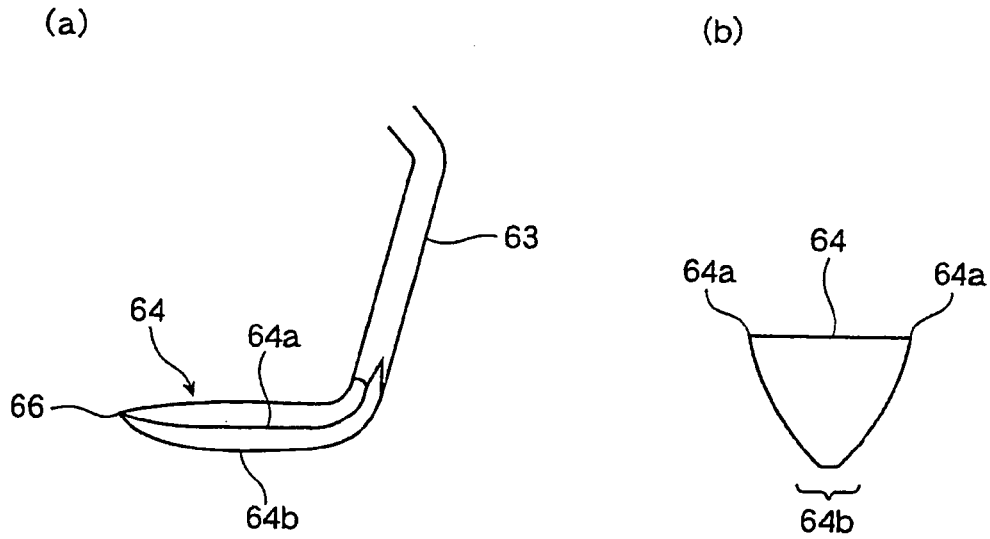
図17
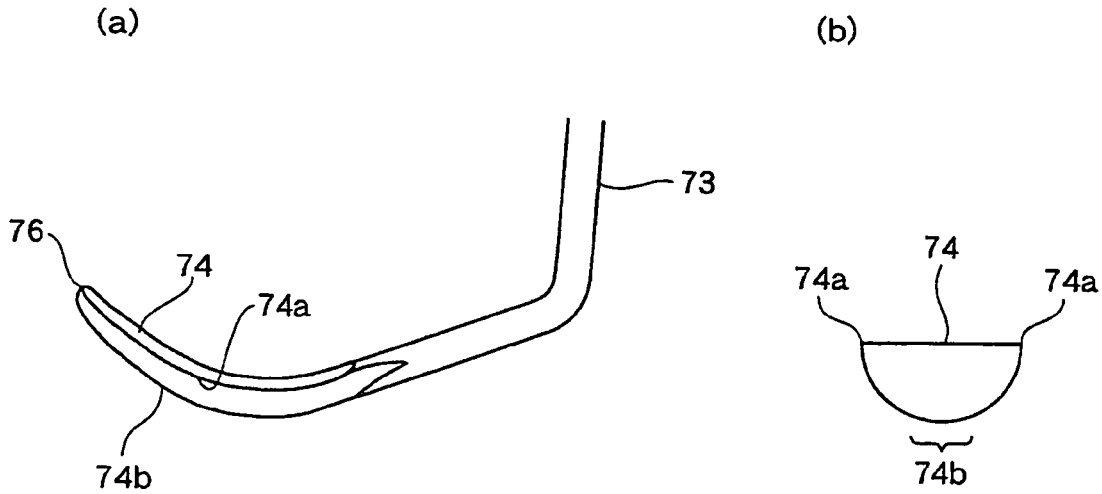

ANGLE POSITIONING TOOL AND HAND-SCALER GRINDING DEVICE USING SAME 10505750 is a national stage entry of PCT/JP03/01911, International Filing Date: 21 Feb. 2003, and claims foreign priority from JP 2002-51395, filed 27 Feb. 2002 and PCT/JP02/07048, International Filing Date Jul. 11, 2002.

FIELD OF ART

The present invention relates to an angle setting tool for use in sharpening a hand scaler, and a hand scaler sharpening device using the same. The present invention relates in particular to an angle setting tool for use in sharpening and repairing cutting edges of hand scalers, such as curet or sickle scalers, which are used for removing dental calculus, plaques, and the like, and to a hand scaler sharpening device using the tool.

BACKGROUND ART

Hand scalers are used for removing dental calculus and the like, and have, for example, as shown in FIGS. 12 and 13, grip section 52 to be grasped by an operator, shank sections 53 provided on both ends of the grip section 52, and blade sections 54 located at the tip of the shank sections 53.

As shown in FIGS. 14 and 15, the blade section 4 of hand scaler 50 has sharpened cutting edges 54*a*, the tip of the blade section 54, i.e., toe 56 is formed rounded, and back face 54*b* is formed on the side opposite to the cutting edges 54*a*. The cutting edges 54*a* are used for scaling off dental calculus and the like, and the toe 56 is rounded so as not to hurt the dental gum upon accidental contact during the calculus removal.

The hand scaler having the blade section 54 with the rounded tip or toe 56 is called a curet hand scaler, while a hand scaler having a blade section with a pointed tip is called a sickle hand scaler.

Various types of curet and sickle scalers are available of which blade sections have different shapes of axes. For example, FIG. 14 illustrates a blade section 54 of a curet hand scaler, wherein the axis of the blade section extends in an arc shape. FIG. 16 illustrates a blade section 64 of a sickle hand scaler, wherein the axis of the blade section extends substantially straight. FIG. 17 illustrates a blade section 74 of another curet hand scaler, wherein the axis of the blade section is formed in an intermediate shape between a straight line and a mild arc. The blade sections 64 and 74 also have, like the blade section 54, cutting edges 64*a*, 74*a* and a back face 64*b*, 74*b*, respectively. The apex of the blade section 64 is pointed and called tip 66, whereas the apex of the blade section 74 is rounded to form toe 76.

As the hand scalers are used for removing calculus, their cutting edges become blunt due to abrasion, so that the edges have to be sharpened and repaired as necessary. Known apparatus for such repairing includes a manual type, wherein the grind stone is moved manually, and a motor-driven type, wherein the grind stone is moved by means of an electric motor or the like.

However, the conventional motor-driven apparatus has problems in that the blade tends to be ground excessively and prematurely worn, and that the apparatus is complex in structure and expensive. In order to prevent such excessive grinding of the blade, means have been proposed for adjusting the contact angle of the cutting edge to the grind stone. However, such adjusting means disadvantageously complex the apparatus structure and handling in maintenance. Thus a hand tool is demanded for easy re-sharpening of hand scalers in situ as desired.

For solving these problems, the present applicant proposed in JP-2001-38584-A a hand scaler sharpener apparatus including a sharpener main body having a grind stone capable of reciprocating, and a detachable attachment. This attachment includes a positioning plate for properly positioning a scaler tip on the grind stone, and having a notch formed in an arc shape substantially corresponding to the arc shape of the blade section of the hand scaler.

With the above-mentioned hand scaler sharpening apparatus, the hand scaler is held in hand, the back face of the blade section is pressed against the arc notch of the positioning plate, and the contact angle between the cutting edge of the blade section and the grind stone is adjusted under visual observation, while the grind stone is reciprocatingly driven. Thus the contact angle between the cutting edge and the grind stone may not be set properly, depending on the experience of the operator who does the sharpening.

In order to minimize such an error in the contact angle, the applicant further proposed in JP-2001-54840-A a hand scaler sharpening apparatus having an angle indication means in addition to the apparatus composition disclosed in the above JP-2001-38584-A. This angle indication means has angle indication lines or angle indication axes, and is positioned along the grind stone and the positioning plate. The operator presses the back face of the blade section of a hand scaler to the arc notch of the positioning plate, views the scaler against a background the angle indication means, and manually adjusts the angle of the scaler so that the axis of the shank section is in alignment with a particular background angle indication line or an angle indication axis, to thereby adjust the contact angle between the cutting edge and the grind stone.

The apparatus disclosed in JP-2001-54840-A indeed enables relatively accurate setting of the contact angle between the cutting edge and the grind stone, but the complexity in setting the contact angle is not sufficiently dissolved.

SUMMARY OF THE INVENTION

It is an object of the present invention to provide an angle setting tool that enables relatively easy and accurate setting of a blade section of a hand scaler at a desired angle for sharpening.

It is another object of the present invention to provide a hand scaler sharpening device that has a relatively simple structure, is easy to operate and do maintenance, and reduces complexity in setting the angle between the blade section and the grind stone for sharpening.

According to the present invention, there is provided an angle setting tool to be placed on a grind stone for setting a blade section of a hand scaler at a predetermined angle during sharpening of the blade section, said angle setting tool comprising at least one inclined surface inclined at a predetermined angle with respect to a bottom surface of said tool.

The angle setting tool according to the present invention is to be placed, for use, on a grind stone capable of reciprocating or on a stationary grind stone. When the angle setting tool is to be used on a stationary grind stone, the shank section of a hand scaler to be sharpened is pressed against one of the inclined surfaces of the setting tool, while the back face of the blade section of the scaler is pressed against a surface facing to that inclined surface. Then the scaler is fixed to the setting tool with fingers or the like so that the relative position between the scaler and the setting tool is not changed, and the scaler and the tool together are moved on the grind stone. In this state, the shank section is kept at a predetermined angle defined by the inclined surface of the setting tool, while the blade section is slid on the grind stone at a constant angle with respect to the grind stone, so that the cutting edge is sharpened to have a predetermined angle. Thus the blade section of a hand scaler may be kept at a predetermined angle while being sharpened, simply by moving the setting tool with the hand scaler on a stationary grind stone. The operation and the maintenance of the setting tool are easy, and the complexity experienced in setting the angle of the blade section for sharpening may be reduced.

The angle setting tool according to the present invention may optionally have a slit along the lower end of each inclined surface.

The width of the slit may be such that, when the shank section of a scaler is pressed against the inclined surface and the blade section of the scaler is placed on the grind stone, the back face of the blade section is pressed against the surface facing to the inclined surface to fix the angle of the cutting edge of the blade section with respect to the upper surface of the grind stone.

The angle setting tool according to the present invention may optionally have a notch in the form of an arc substantially corresponding to the arc of the blade section of the hand scaler.

The angle setting tool of the present invention may further have a hole for receiving the toe of a curet hand scaler for rounding by grinding.

According to the present invention, there is also provided a hand scaler sharpening device having the angle setting tool mentioned above, and a sharpener main body including a grind stone capable of reciprocating.

With the hand scaler sharpening device of the present invention, by simply holding a hand scaler in hand and pressing the shank section of the scaler against one of the inclined surfaces of the angle setting tool, the contact angle of the cutting edge of the scaler with respect to the grind stone is properly set, and the cutting edge is sharpened to have an appropriate angle. In addition, since each inclined surface is formed to provide a different angle, an inclined surface of an appropriate, desired angle may be selected for sharpening the cutting edge to have a desired angle.

The angle setting tool of the hand scaler sharpening device according to the present invention may optionally have a slit along the lower end of each inclined surface.

The width of the slit may be such that, when the shank section of a hand scaler is pressed against the inclined surface and the blade section of the scaler is placed on the grind stone, the back face of the blade section is pressed against the surface facing to that inclined surface to fix the angle of the cutting edge of the blade section with respect to the upper surface of the grind stone.

The angle setting tool may have at least one projected portion, and the at least one inclined surface may be provided on that projected portion.

Further, a pair of the projected portions may be provided spaced apart from each other for allowing reciprocating motion of the grind stone between the projected portions.

BRIEF DESCRIPTION OF THE DRAWINGS

FIG. 1 is a plan view of an embodiment of the angle setting tool according to the present invention.

FIG. 2 is a sectional view taken along lines II-II in FIG. 1.

FIG. 3 schematically shows sharpening of a hand scaler using the angle setting tool.

FIG. 4 is a perspective view of the angle setting tool placed on a grind stone.

FIG. 5 is a perspective view of an embodiment of the hand scaler sharpening device according to the present invention.

FIG. 6 is an exploded view of the hand scaler sharpening device of FIG. 5.

FIG. 7 schematically shows sharpening of a hand scaler.

FIG. 8 is a perspective view of another hand scaler sharpening device.

FIG. 9 is a perspective view of the angle setting tool of the device of FIG. 8.

FIG. 10 is a perspective view of a hand scaler sharpening device different from those of FIGS. 5 and 8.

FIG. 11 is an exploded view of the hand scaler sharpening device of FIG. 10.

FIG. 12 is a perspective view of a conventional hand scaler.

FIG. 13 is an enlarged view of the blade and shank sections of the hand scaler.

FIG. 14 is an enlarged perspective view of the blade section.

FIG. 15 is a sectional view of the blade section.

FIG. 16(*a*) is a side view of a conventional hand scaler of a type different from that of FIG. 14, and FIG. 16(*b*) is a sectional view of the blade section thereof.

FIG. 17(*a*) is a side view of a conventional hand scaler of a type different from those of FIGS. 14 and 16, and FIG. 17(*b*) is a sectional view of the blade section thereof.

PREFERRED EMBODIMENTS OF THE INVENTION

The present invention will now be explained with reference to preferred embodiments thereof taken in conjunction with the attached drawings.

FIG. 1 is a plan view of angle setting tool 41 as an embodiment of the present invention, and FIG. 2 is a sectional view of the tool taken along lines II—II in FIG. 1.

The angle setting tool 41 is a plate-like member made of, for example, stainless steel, and having a generally rectangular top plan shape, with at least the bottom surface 48 being formed flat. The angle setting tool 41 has three openings 42, 43, 44 formed in the upper face, which openings are used for sharpening cutting edge 64*a* of blade section 64 having the axis extending substantially straight as shown in FIG. 16, or cutting edge 74*a* of blade section 74 having the axis formed in an intermediate shape between a straight line and an arc as shown in FIG. 17. Each of the openings 42, 43, 44 is defined by inclined surface 42*a*, 43*a*, 44*a* against which the shank section of a hand scaler is to be pressed, vertical surface 42*b*, 43*b*, 44*b* facing to each inclined surface, and slit 42*c*, 43*c*, 44*c* through the bottom surface 48.

In this embodiment, the inclined surfaces 42*a*, 43*a*, 44*a* are formed at $\alpha=40°$, $\beta=30°$, and $\gamma=20°$ with respect to the bottom surface, respectively. However, the angles of the inclined surfaces 42*a*, 43*a*, 44*a* are not limited to these angles, and may suitably be formed at different angles depending on the angles to be given to the cutting edge 64*a*, 74*a*. The width of each slit 42*c*, 43*c*, 44*c*, that is the width of each slit in the direction of arrow W in FIG. 1, is decided such that, when the shank section 63, 73 of a hand scaler is pressed against the inclined surface 42*a*, 43*a*, 44*a* and the blade section 64, 74 of the scaler is placed on the grind stone, the back face 64*b*, 74*b* of the blade section 64, 74 is pressed against the vertical surface 42*b*, 43*b*, 44*b*, to fix the blade section 64, 74 at a predetermined angle with respect to the upper surface of the grind stone.

Further, the angle setting tool 41 has hole 46 formed in the inclined surface 44*a* through the bottom surface, notch 47 in the form of an arc formed in the side edge of the inclined surface 44*a*, and slot 45 to be used for fixing the angle setting tool 41 with a screw or the like. The hole 46 is used by inserting the toe of a curet hand scaler into this hole and turning around the toe therein for rounding. The notch 47 in the form of an arc is used for sharpening cutting edge 54*a* of blade section 54 in the form of an arc as shown in FIG. 14, and is formed in an arc shape substantially corresponding to the arc shape of the blade section 54. With this notch, the cutting edge 54*a* of the scaler is sharpened by moving the blade section 54 along the arc notch surface, with the shank section 53 of the scaler being kept at about 20° to 30°.

Next, how to use the angle setting tool 41 of the present invention is to be explained.

The angle setting tool 41 is placed on a grind stone 50 as shown in FIG. 4. The blade section 64 is inserted into, for example, the opening 43 and positioned on the grind stone 50 seen through the slit 43*c*. The shank section 63 is pressed against the inclined surface 43*a*, while the back face 64*b* of the blade section 64 is pressed against the vertical surface 43*b*. In this position, the cutting edge 64*b* of the blade section 64 is set in a pressed position against the upper surface of the grind stone 50 at a predetermined angle. Then with the hand scaler being held to the angle setting tool 41 with fingers or the like so that the relative position of the blade and shank sections 64 and 63 with respect to the tool 41 is not changed, the scaler and the tool 41 together are moved on the grind stone 50. The blade section 64 is kept at a constant angle and slid on the grind stone with the shank section 63 being kept at a constant angle defined by the inclined surface 43*a* of the tool 41, so that the cutting edge 64*a* is sharpened to have a predetermined angle. Here, when the hand scaler and the angle setting tool 41 are reciprocated on the grind stone 50, the grind stone 50 stays stationary.

As discussed above, the blade section of the scaler may be sharpened simply by sliding the angle setting tool 41 with the hand scaler on the stationary grind stone 50. Thus maintenance and operation are easy, and the complexity in setting the angle of the blade section for sharpening is reduced.

While the use of the angle setting tool 41 on a stationary grind stone is discussed above, the tool 41 may be used in any manner without limitation, and may be combined with a sharpener main body having a grind stone which is provided for reciprocating motion, as will be discussed below.

FIG. 5 is a perspective view of an embodiment of the hand scaler sharpening device of the present invention, and FIG. 6 is a perspective view of the hand scaler sharpening device of FIG. 5 shown exploded into a sharpener main body 11 and an angle setting tool 21.

The sharpener main body 11 has grind stone 13, body section 15, grind stone holder member 14 which detachably holds the grind stone 13 and is capable of reciprocating on the surface of the body section 15, and a switch (not shown) for starting and stopping the reciprocating motion of the grind stone holder member 14. The body section 15 accommodates therein, though not show in the drawings, a drive unit, such as a motor, a battery as a power source for the drive unit, and a transmission mechanism, such as link mechanisms and cams, for transmitting the force from the drive unit to the grind stone holder member 14 to effect the reciprocating motion. With this structure, by turning the switch on, the grind stone holder member 14 with the grind stone 13 reciprocates in the direction of arrows M.

The angle setting tool 21 is detachably mounted on the sharpener main body 11, and has recess 26 in its bottom surface for providing clearance between the tool 21 and the reciprocating grind stone 13 as shown in FIG. 6. The angle setting tool 21 is also provided with three openings 22, 23, 24, which are used for sharpening the cutting edge 64*a* of the blade section 64 having the axis extending substantially straight as shown in FIG. 16, or the cutting edge 74*a* of the blade section 74 having the axis formed in an intermediate shape between a straight line and an arc as shown in FIG. 17. Each of the openings 22, 23, 24 is defined by inclined surface 22*a*, 23*a*, 24*a*, vertical surface 22*b*, 23*b*, 24*b* facing to each inclined surface, and slit 22*c*, 23*c*, 24*c*. The inclined surfaces 22*a*, 23*a*, 24*a* are formed at 30°, 40°, and 50° with respect to the bottom surface of the angle setting tool 21, more specifically, the bottom surface at the recess 26, respectively. However, the angles of the inclined surfaces 22*a*, 23*a*, 24*a* are not limited to these angles, and may suitably be formed at different angles depending on the angles to be given to the cutting edge 64*a*, 74*a*.

Further, the gap between each inclined surface 22*a*, 23*a*, 24*a* and the corresponding vertical surface 22*b*, 23*b*, 24*b* is formed in a size such that, for example as shown in FIG. 7, when the shank section of a hand scaler is pressed against the inclined surface 22*a*, 23*a*, 24*a* and the blade section 74 of the scaler is placed on the grind stone 13, the back face 74*b* of the blade section 74 is pressed against the vertical surface 22*b*, 23*b*, 24*b*, and the reaction force from the vertical surface prevents displacement of the blade section 74.

The angle setting tool 21 is also provided with a slot 25, through which screw 26 is inserted and tightened into a screw hole in the sharpener main body 11. The angle setting tool 21 is detachably fixed to the sharpener main body by means of tightening or loosening of this screw 26.

The angle setting tool 21 is shown to have the recess 26 for providing clearance between the tool 21 and the reciprocating grind stone 13. However, this recess 26 is not always necessary depending on the configuration of the sharpener main body 11. For example, though not shown, the recess 26 may be eliminated if the body section 15 is provided in its surface with a depression, in which the grind stone holder member 14 and the grind stone 13 are disposed for reciprocating motion, with the top surface of the grind stone 13 being out of touch with the bottom surface of the angle setting tool 21. With this structure, even the angle setting tool 41 having a flat bottom surface may be attached to and used with the sharpener main body.

FIG. 7 is a schematic view showing how a curet hand scaler is sharpened by means of the hand scaler sharpening device 10. This is explained with reference to FIGS. 5 and 7. Incidentally, while FIG. 7 shows only a curet hand scaler, it is understood that the hand scaler sharpening device 10 may also be used for sickle scalers as well.

In FIG. 7, for sharpening the hand scaler, the shank section of the hand scaler is pressed against the inclined surface 24*a* and the cutting edge 74*a* is pressed against the grind stone 13, while the back face 74*b* of the blade section 74 is pressed against the vertical surface 24*b*. In this position, the angle $\alpha°$ of the blade section 74 with respect to the grind stone 13 is set. When the switch is turned on, the grind stone 13 reciprocates in the direction of arrows M, while the angle setting tool 21 and the blade section 74 of the hand scaler 1 remain stationary. The contact angle of the blade section 74 with respect to the grind stone 13 is kept constant, so that the cutting edge 74*a* is sharpened to have a desired angle by means of the relatively reciprocating grind stone 13.

As discussed above, the shank section 73 is pressed against any of the inclined surfaces 22*a*, 23*a*, 24*a*, and the back face 74*b* of the blade section 74 is pressed against the corresponding vertical surface 22*b*, 23*b*, 24*b*. Thus the displacement of the blade section 4 in the direction of the reciprocating motion of the grind stone 13 or the direction transverse thereto may be prevented simply by properly adjusting the magnitude of the force to be applied to the hand scaler.

Next, FIG. 8 shows, in perspective, another hand scaler sharpening device 80, which is different from the embodiment shown in FIG. 5. FIG. 9 illustrates the angle setting tool used in this hand scaler sharpening device.

Referring to FIG. 8, hand scaler sharpening device 80 includes sharpener main body 11 and angle setting tool 81. The angle setting tool 81 has slot 85, through which screw 87 is inserted and tightened into a screw hole in the sharpener main body 11 to detachably fix the angle setting tool 81. Here, the sharpener main body 11 is the same as the one in FIG. 5, so that detailed explanation regarding its structure is eliminated.

The angle setting tool 81 may be detachably fixed to the sharpener main body 11, and has three openings 82, 83, 84, each of which is defined by inclined surface 82*a*, 83*a*, 84*a*, vertical surface 82*b*, 83*b*, 84*b* facing to each inclined surface, and slit 82*c*, 83*c*, 84*c*. The inclined surfaces 82*a*, 83*a*, 84*a* are formed at different angles with respect to the bottom surface of recess 86 in the angle setting tool 81. These structures are almost the same as those in the angle setting tool 21 of FIG. 5, but differ in that the inclined surfaces 82*a*, 83*a*, 84*a* and the vertical surfaces 82*b*, 83*b*, 84*b* of the angle setting tool 81 extend over the full width in the direction of arrow S in FIG. 9.

As shown in FIG. 9, the angle setting tool 81 has recess 86 formed in its bottom surface for providing clearance between the tool 81 and the reciprocating grind stone 13, and lateral sections 87*a*, 87*b* arranged on both sides of the recess 86. The inclined surfaces 82*a*, 83*a*, 84 and the vertical surfaces 82*b*, 83*b*, 84*b* extend over the lateral sections 87*a*, 87*b*. By arranging the inclined surfaces 82*a*, 83*a*, 84*a* and the vertical surfaces 82*b*, 83*b*, 84*b* to extend over the entire width in the direction of the arrow S, the shank section 73 will not contact the lateral sections 87*a*, 87*b* wherever in the lateral direction the blade section 74 is positioned on the grind stone 13 during sharpening, to thereby facilitate sharpening operation of the hand scaler.

Another hand scaler sharpening device 30, which is different from those shown in FIGS. 5 and 8, is shown in FIG. 10 in perspective, and in FIG. 11 in an exploded view.

Referring to FIGS. 10 and 11, the hand scaler sharpening device 30 includes sharpener main body 11 and angle setting tool 31. Here, the sharpener main body 11 is the same as the one in FIG. 5, so that detailed explanation regarding its structure is eliminated.

The angle setting tool 31 may be detachably fixed to the sharpener main body 11, and has recess formed in its bottom surface for providing clearance between the tool 31 and the grind stone 13 of the sharpener main body 11. As shown in FIG. 11, the angle setting tool 31 has cut-out 32, on both sides of which projections 34, 34 are provided. These two projections 34, 34 are spaced apart from each other for allowing reciprocating motion of the grind stone 13 therebetween. Each of the projections 34 has inclined surface section 33 having a plurality of inclined surfaces 33*a*, 33*b*, 33*c* formed at different angles with respect to the bottom surface of the angle setting tool 31. The inclined surfaces are formed to define the angle to be given to the cutting edge 4*a* by sharpening, depending on the angle of the inclined surface selected.

Vertical surface 32*a* facing to the inclined surface section 33 is shown in FIG. 10 at a distance from the inclined surface section 33 for not allowing contact of a back face of the blade section 74 thereto. However, it is understood that the distance between the inclined surface section 33 and the facing surface 32*a* may suitably be closed to allow contact of the back face of the blade section 74 to the facing surface 32*a* when the shank section of the hand scaler is pressed against the inclined surface 33*a*, 33*b*, 33*c*, to prevent displacement of the blade section 74 with the reaction force from the facing surface 32*a*.

The angle setting tool 31 has slot 35, through which screw 36 is inserted and tightened into a screw hole in the body section 15 to detachably fix the angle setting tool 31.

Sharpening of the cutting edge 74*a* may be performed with the hand scaler sharpening device 30 in the similar manner as with the hand scaler sharpening device 10.

Specifically, for sharpening the hand scaler 1, the shank section 73 of the hand scaler is pressed against one of the inclined surfaces 33*a*, 33*b*, 33*c*, while the cutting edge 74*a* is pressed against the grind stone 13. In this position, the contact angle of the blade section 74 with respect to the grind stone 13 is set. When the switch is turned on to operate the hand scaler sharpening device 10, the grind stone 13 reciprocates in the direction of arrows M, while the angle setting tool 31 and the blade section 74 remain stationary on the grind stone 13. The cutting edge 74*a* is sharpened with the grind stone 13 to have a desired angle by the relatively reciprocating motion of the grind stone 13.

The hand scaler sharpening device 30 has the projections 34 arranged on the opposite sides of the grind stone 13. This is because one blade has two cutting edges on its opposite sides, with the direction of the blade axis upon sharpening one of the cutting edges being opposite to the direction of the axis upon sharpening the other. When the sharpening of one cutting edge is completed on one of the projections 34, the inclined surface 33*a*, 33*b*, 33*c* of the other of the projections 34 is used for sharpening the other cutting edge.

The hand scaler sharpening device according to the present invention has a sharpener main body of a simple structure having a grind stone provided for reciprocating motion, and an angle setting tool provided with a plurality of inclined surfaces at predetermined angles for setting the tip of a hand scaler on the grind stone at a plurality of predetermined angles. Thus in the sharpening operation, by simply grasping the hand scaler with hand and pressing the shank section against one of the inclined surfaces, the contact angle of the cutting edge with respect to the grind stone may be set optimally, and the cutting edge may be sharpened to have a desired angle.

Therefore, the present invention provides, with a relatively simple structure, optimal setting of a contact angle of the cutting edge of a hand scaler with respect to the grind stone for sharpening, simply by pressing the hand scaler against the inclined surface. Thus the complexity in the sharpening operation may be reduced.

What is claimed is:

1. An angle setting tool to be placed on a grind stone for setting a blade section of a hand scaler at a predetermined angle during sharpening of the blade section, said angle setting tool comprising:

at least one inclined surface inclined at a predetermined angle with respect to a bottom surface of said tool, a recess for fitting at least a portion of a grind stone therein, when placed on the grind stone and, a slit along a lower end of each inclined surface, wherein said slit has such a width that, when a shank section of the hand scaler is pressed against said inclined surface and said blade section of the scaler is placed on the grind stone, a back face of the blade section is pressed against a surface facing to said inclined surface to fix an angle of a cutting edge of the blade section with respect to an upper surface of the grind stone.

2. The angle setting tool of claim 1, wherein said inclined surface and said surface facing to the inclined surface extend over an entire width of the angle setting tool.

3. The angle setting tool of claim 1, further comprising a notch in a form of an arc shape substantially corresponding to an arc shape of the blade section of the hand scaler.

4. The angle setting tool of claim 1, further comprising a hole for receiving a toe of a curet hand scaler for rounding said toe by grinding.

5. A hand scaler sharpening device comprising an angle setting tool of claim 1, and a sharpener main body having a grind stone capable of reciprocating.

6. The hand scaler sharpening device of claim 5, wherein said angle setting tool has at least one projected portion, said at least one inclined surface being provided on said at least one projected portion.

7. The hand scaler sharpening device of claim 6, comprising a pair of said projected portions spaced apart from each other for allowing reciprocating motion of the grind stone between the projected portions.

8. An angle setting tool to be placed on a grind stone for setting a blade section of a hand scaler at a predetermined angle during sharpening of the blade section by reciprocating motion of the grind stone, said angle setting tool comprising at least one inclined surface inclined at a predetermined angle with respect to a bottom surface of said tool, and extending transversely to the direction of a reciprocating motion of the grind stone, and a slit along a lower end of each inclined surface, wherein said slit has such a width that, when a shank section of the hand scaler is pressed against said inclined surface and said blade section of the scaler is placed on the grind stone, a back face of the blade section is pressed against a surface facing to said inclined surface to fix an angle of a cutting edge of the blade section with respect to an upper surface of the grind stone.

9. The angle setting tool of claim 8, wherein said inclined surface and said surface facing to the inclined surface extend over an entire width of the angle setting tool.

10. The angle setting tool of claim 8, further comprising a notch in a form of an arc shape substantially corresponding to an arc shape of the blade section of the hand scaler.

11. The angle setting tool of claim 8, further comprising a hole for receiving a toe of a curet hand scaler for rounding said toe by grinding.

12. A hand scaler sharpening device comprising an angle setting tool of claim 8, and a sharpener main body having a grind stone capable of reciprocating.

13. The hand scaler sharpening device of claim 12, wherein said angle setting tool has a recess for fitting at least a portion of the grind stone therein.

14. The angle setting tool of claim 1, wherein the surface facing to said inclined surface is substantially vertical.

15. The hand scaler sharpening device of claim 5, wherein the surface facing to said inclined surface is substantially vertical.

16. The angle setting tool of claim 8, wherein the surface facing to said inclined surface is substantially vertical.

* * * * *